US006871727B2

(12) United States Patent
Jokela et al.

(10) Patent No.: US 6,871,727 B2
(45) Date of Patent: Mar. 29, 2005

(54) ELEVATOR SYSTEM WITH ONE OR MORE CARS MOVING INDEPENDENTLY IN A SAME SHAFT

(75) Inventors: Simo Jokela, Hyvinkää (FI); Riitta Partanen-Jokela, Hyvinkää (FI); Johannes De Jong, Järvenpää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 10/796,991

(22) Filed: Mar. 11, 2004

(65) Prior Publication Data

US 2004/0173417 A1 Sep. 9, 2004

Related U.S. Application Data

(63) Continuation of application No. PCT/FI02/00816, filed on Oct. 21, 2002.

(30) Foreign Application Priority Data

Oct. 29, 2001 (FI) ..... 20012094

(51) Int. Cl.[7] ..... B66B 1/36
(52) U.S. Cl. ..... 187/383; 187/249; 187/385
(58) Field of Search ..... 187/247, 249, 187/380, 382, 383, 385, 387, 388, 902

(56) References Cited

U.S. PATENT DOCUMENTS 3,750,849 A * 8/1973 Berkovitz ..... 187/266
4,838,385 A * 6/1989 Ekholm ..... 187/247
5,419,414 A 5/1995 Sakita
5,460,245 A * 10/1995 Bittar ..... 187/383
5,663,538 A 9/1997 Sakita
5,719,360 A * 2/1998 Davis et al. ..... 187/383
5,749,441 A * 5/1998 Bittar et al. ..... 187/249
5,785,153 A * 7/1998 Powell et al. ..... 187/249
5,844,179 A * 12/1998 Walker et al. ..... 187/382
5,969,304 A * 10/1999 Barker et al. ..... 187/383
6,273,217 B1 8/2001 Hikita
6,601,678 B2 * 8/2003 Kostka et al. ..... 187/383

FOREIGN PATENT DOCUMENTS

JP 54053450 A * 4/1979 ..... B66B/1/18
JP 04080185 A * 3/1992 ..... B66B/1/20
JP 04106086 A * 4/1992 ..... B66B/5/02
JP 06009163 A * 1/1994 ..... B66B/1/18
JP 10-109854 A 4/1998

* cited by examiner

*Primary Examiner*—Jonathan Salata
(74) *Attorney, Agent, or Firm*—Birch, Stewart, Kolasch & Birch, LLP

(57) ABSTRACT

The invention relates to an elevator system in tall buildings, the system having at least one first elevator shaft, which houses an elevator arranged to stop at floors called transfer levels, and at least one second elevator shaft, which houses elevators whose elevator cars are disposed one above the other in the elevator shaft, which elevator cars are designed to stop during their travel at any floor to which or from which a call has been issued. The second elevator shaft is divided vertically into local shafts situated one above the other, the number of which is at least one for each zone between transfer levels.

9 Claims, 5 Drawing Sheets

ELEVATOR SYSTEM WITH ONE OR MORE CARS MOVING INDEPENDENTLY IN A SAME SHAFT

CROSS REFERENCE TO RELATED APPLICATION

This application is a Continuation of co-pending PCT International Application No. PCT/FI02/00816 filed on Oct. 21, 2002, which designated the United States, and on which priority is claimed under 35 U.S.C. § 120, the entire contents of which are hereby incorporated by reference.

BACKGROUND OF THE INVENTION

Field of the Invention

The present invention relates to an elevator system especially for high-rise multi-floor buildings where a passenger who wants to get to a floor in the top part has to change to an elevator that mainly serves the topmost floors only.

In very tall buildings, it is generally economically not possible to provide elevator shafts extending through the entire height of the building from the bottom floor to the top floor so that each elevator could serve all floors. For this reason, elevators are traditionally divided into different zones in the vertical direction, of which the lowest zone extends from the entrance floor, hereinafter called ground floor, to a floor at a given height, this zone being called low-rise zone, while the highest zone, called high-rise zone, extends from a given transfer floor, a so-called sky lobby floor to the topmost floors of the building. Between these zones, depending on the height of the building, there may be one or more intermediate zones, so-called mid-rise zones serving intermediate floors in the building from their respective transfer floors. The problem is generally that each zone is served by only one elevator in one elevator shaft, so it is necessary to provide for each zone and each elevator car a separate shaft extending from the ground floor of the building to the top floor of the zone. In addition, a machine room is generally provided above each elevator, which requires more space. Moreover, with increasing building height, there is the problem that it is difficult to provide a sufficient transport capacity especially to the higher floors, because in the highest shaft the traveling distance from the ground floor to the highest sky lobby is long. A further disadvantage is the highest shafts is the difficulty of compensation of long elevator ropes, which is not encountered in lower elevator shafts as the ropes are shorter.

In tall buildings, however, a single elevator aggregate with zone divisions like this does not have a sufficient capacity to serve all users; instead, several parallel elevators forming a group are needed in the same zone. A typical group consists of eight elevators serving the same zone, which may comprise e.g. floors 31–15. Often an elevator group like this is needed for each zone, for example for a mid-zone to serve floors 16–30 and a top zone to serve floors 31–45. The problem is that, in the case of this example, 24 elevator shafts are required, each of which extends from the ground floor upwards although only the eight elevators in the lowest group serve the fifteen lowest floors. The elevators serving the intermediate and top zones do not stop at the lower floors, so the lobby space and particularly the shaft space needed for them constitute expensive unused space for the owner of the building. The unused lobby spaces can be utilized e.g. as storage spaces or for lavatories on different floors, but the corresponding shaft space cannot be utilized in any way.

2. Description of Related Art

U.S. Pat. No. 5,419,414 represents a prior-art solution for an elevator arrangement in tall buildings. In this solution, three elevator cars are placed one over the other in the same shaft so that each car is moved separately by means of an elevator machine mounted above each common elevator shaft. Thus, a separate machine is provided for each elevator car, and the elevator ropes run from the machines to the elevator cars in a interlapping manner so that the ropes going to the lowest car pass by the two higher cars and the ropes going to the intermediate car pass by the uppermost car. The cars can be moved in relation to each other on at least four different operating principles. According to a first principle, each car always moves in its own shaft section and never enters the zone of another car. According to another principle, each car can serve all floors, but only one car can be moving at a time. According to a third principle, the cars can move simultaneously in different zones, but only in one direction at a time. Finally, according to a fourth operating principle, the cars can move simultaneously in different directions provided that safety is guaranteed. For example, when the two lower cars are going downwards, the highest car can move upwards. The proposed elevator system is very complicated and it is obvious that such a system involves the problem of how to construct a sufficiently simple and safe control system. Even if the control system were ever so safe, the system may still get out of order, in which case a collision between two cars is possible.

U.S. Pat. No. 6,273,217 also discloses an elevator solution in which more than one elevator cars are travel in the same elevator shaft. The solution presented in the patent is focused on preventing a possible collision of two elevator cars by means of a program. If a risk of collision appears, one of the elevator cars is moved away to give way to the other one. The problem in this case, too, is exactly a risk of collision, because there is always the possibility that, if a program malfunction or error occurs, two elevator cars running towards each other in the same shaft will collide.

BRIEF SUMMARY OF THE INVENTION

The object of the present invention is to eliminate the above-mentioned drawbacks and to achieve an economical, reliable and well-functioning elevator system for tall buildings, said elevator system comprising one or more elevator cars moving in the same shaft independently of each other.

The solution of the invention has the advantage that by using simple solutions a reliable and safe elevator system is achieved that guarantees a good transport capacity in tall buildings and enables space savings to be made in respect of expensive floor area. According to the invention, for an elevator system in a building of the same height, elevator shafts are only needed for two elevator groups instead of three and yet at least the same capacity is achieved as in prior-art solutions. The greatest space saving is gained by leaving out the above-mentioned lowest zone, the so-called low-rise zone as separate elevator shafts, so that the entire shaft and lobby spaces for this zone, i.e. e.g. floors 1–15, can be used for other purposes. In the case of an elevator group of eight elevators, the additional area thus provided will be about 150 $m^2$ for each floor. As the fifteen lowest floors can well be used as business premises, the rent per square meter of area of such floor space is generally high and therefore the elevator system of the invention allows the owner of the building to earn a good income from rents. An additional advantage is that, although the elevator cars travel in the same shaft independently of each other, they never collide because the hoisting ropes of different elevator cars are not interlapped in the vertical direction and there is therefore no risk of the elevator cars getting into each other's range of movement.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
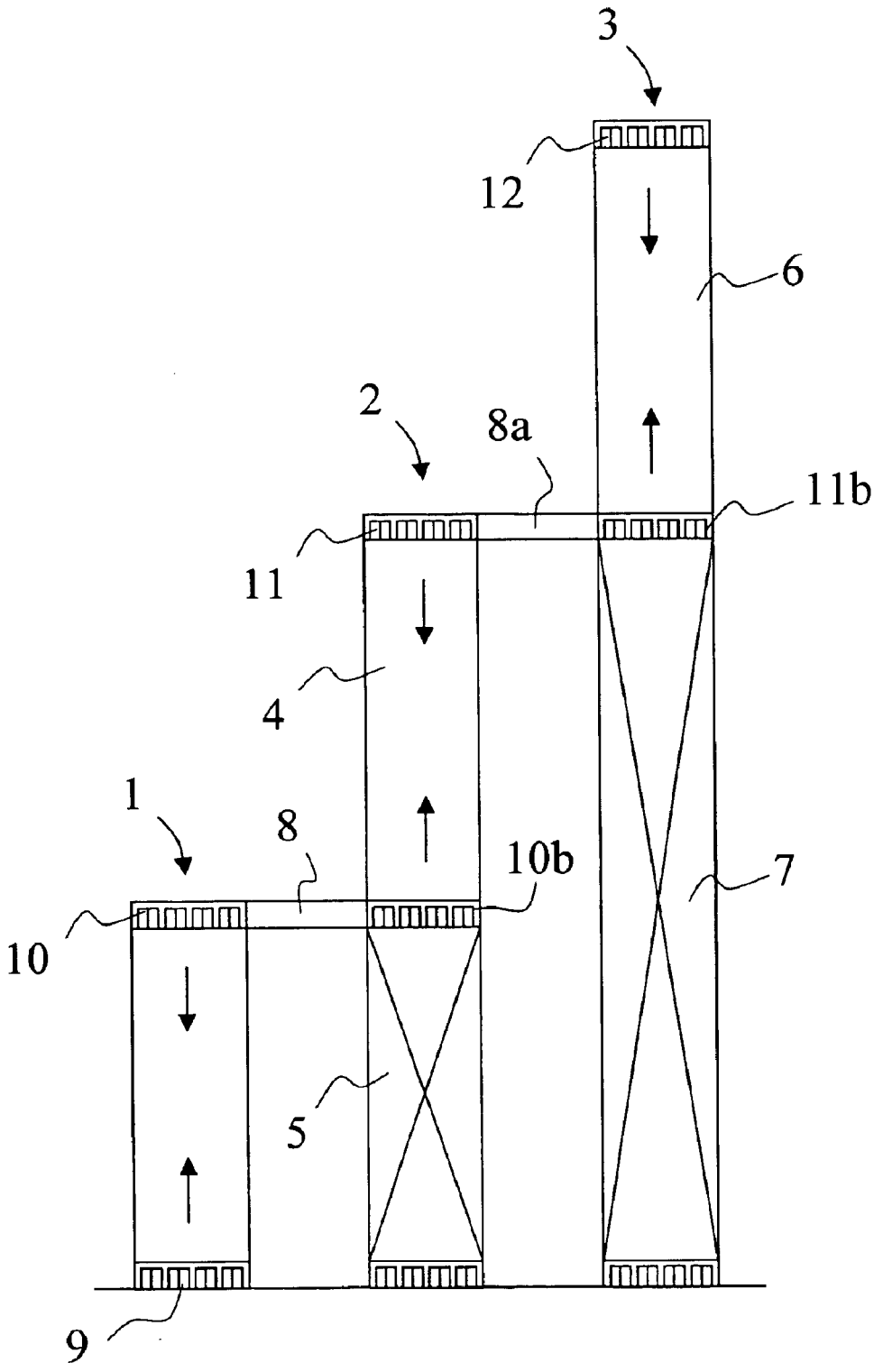
Fig. 1 PRIOR ART
FIG. 1 presents a simplified diagrammatic view of a prior-art elevator system as seen from the front side of the elevators.
Figure 2:
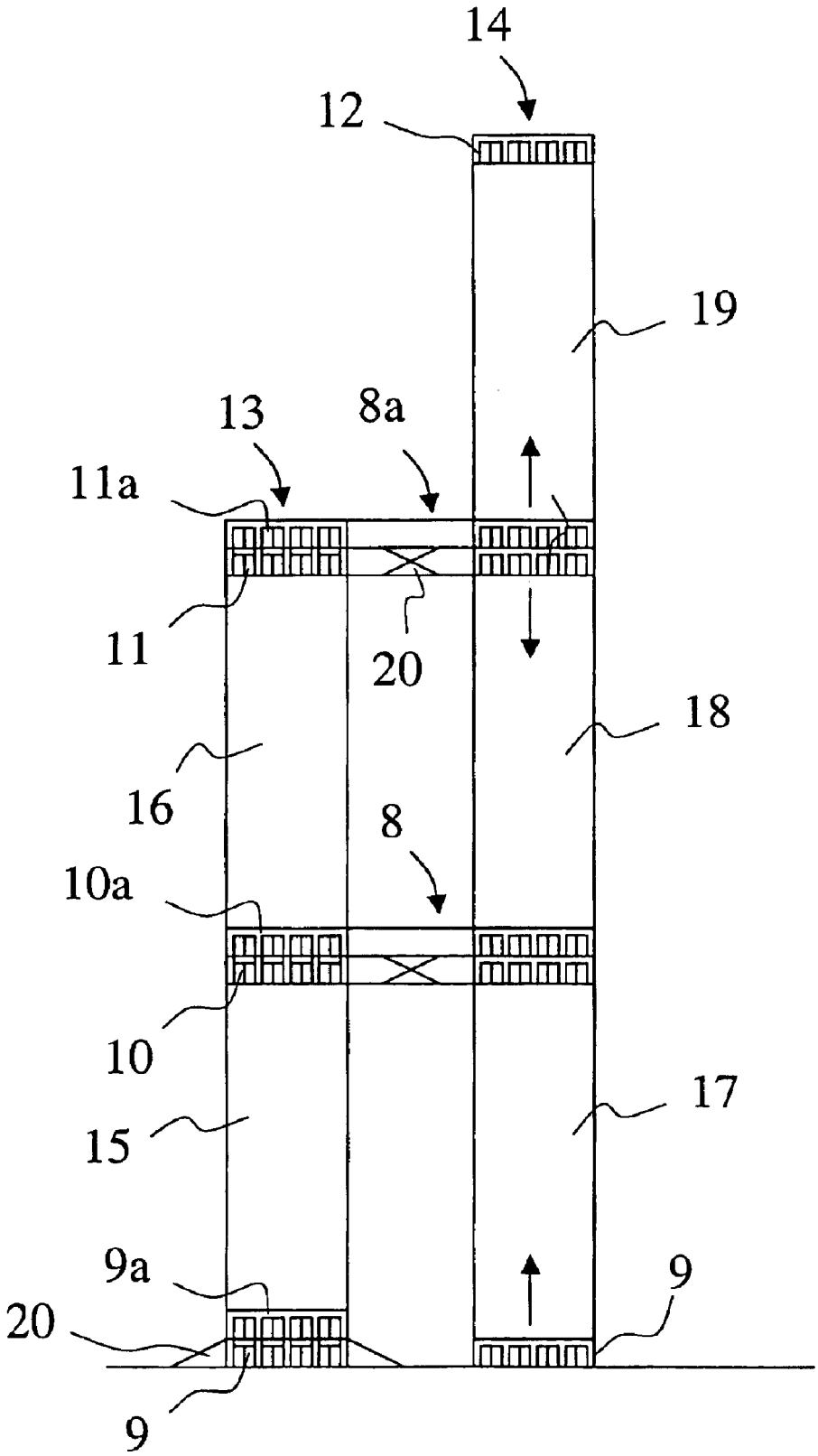
FIG. 2 presents a simplified diagrammatic view of an elevator system according to the invention as seen from the front side of the elevators.
Figure 3:
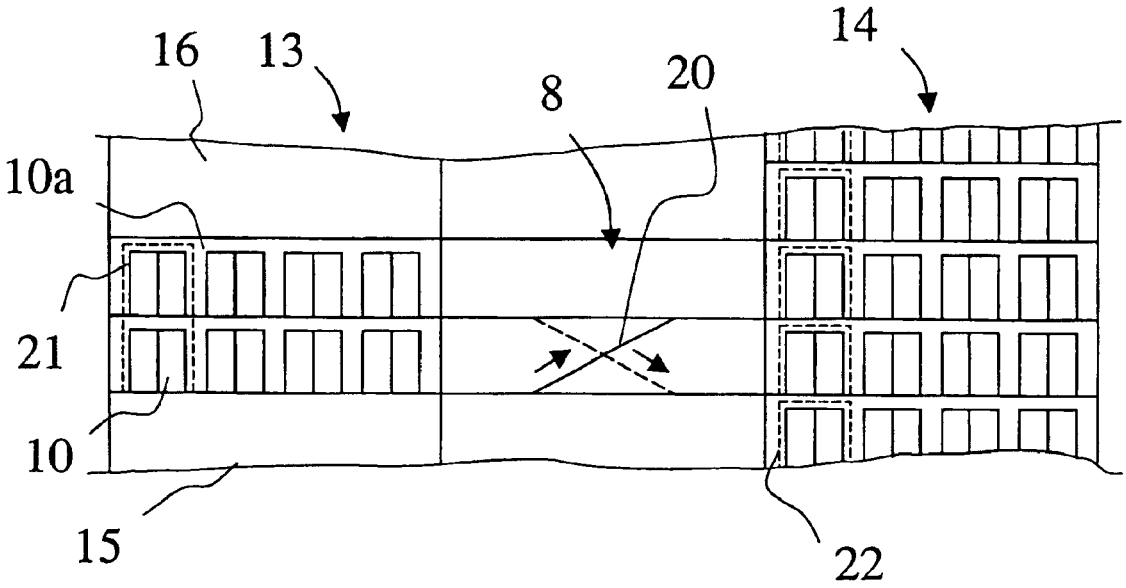
FIG. 3 presents a magnified view of a transfer level in the elevator system of the invention presented in FIG. 2 as seen from the front side of the elevators.
Figure 4:
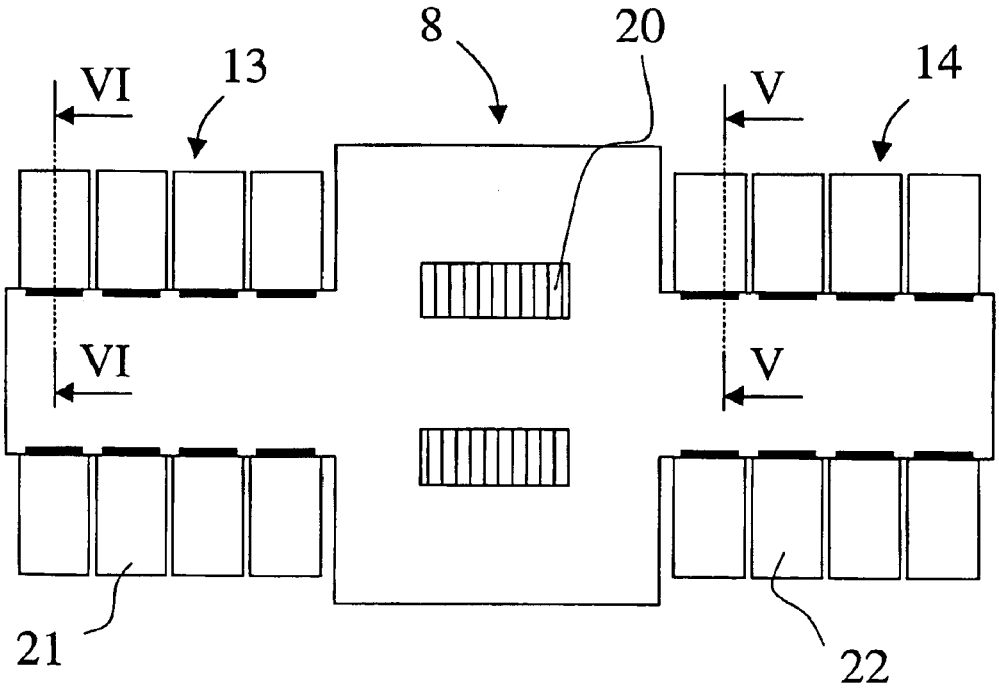
FIG. 4 presents a simplified diagrammatic view of a transfer level as shown in FIG. 3 as seen from above.

The solution illustrated in FIG. 1 represents the aforesaid prior-art elevator system for tall buildings. Let us consider e.g. a 45-floor building with fifteen floors in each zone. The number of floors in each zone is determined by the number of elevators and the car size and speed of the elevators. The system comprises three different height zones, so it requires three different banks of elevator shafts 1, 2 and 3, of which bank 1 forms the lowest zone, which comprises e.g. a group of eight elevators serving all fifteen lowest floors from the ground floor 9 to the highest floor 10 of the zone. FIG. 1 only shows the elevator doors of four elevators on the ground floor 9 and the highest floor 10 of the zone. Within this zone, the elevators can stop at any floor.

The second zone in the prior-art elevator system is a so-called mid-zone, which may also comprise a group of eight elevators in a separate bank of elevator shafts 2, which now serves only the ground floor 9, the first transfer level 8, which in the solution illustrated by the example is the fifteenth floor, and all floors above it up to the second transfer level 8*a*, which in the solution illustrated by the example is the thirtieth floor of the building. The elevators in bank 2 never stop within the zone 5 of the lowest fifteen floors except at the ground floor. If these elevators in bank 2 do not have a so-called express function, then they will not take in any passengers from the ground floor 9 at all, but they only operate within zone 4 of bank 2. In this case, no doors are provided on the ground floor 9 for the elevators in bank 2. Thus, a person who wants to reach one of the floors in zone 4, e.g. floor 20, first has to take an elevator in bank 1 and have a ride on it to transfer floor 10, then move on via a transfer area 8 to the elevator lobby lob for zone 4 and ride further on an elevator in zone 4 to floor 20.

The high-rise zone of the prior-art elevator system is served by an elevator group in bank 3. The elevators in this group do not stop at the floors 7 in the low-rise and mid-rise zones at all. Instead, they either operate exclusively between the floors of the high-rise zone 6, e.g. floors 31–45, or, if they are provided with an express function, they also travel from the ground floor 9 directly to the second transfer level 8*a*, which is the lowest floor 11*b* of the high-rise zone. If no express function is implemented, then a passenger going to a floor in the upper zone 6 has to travel by the route: bank 1, first transfer level 8, zone 4 of bank 2, zone 6 of bank 3. For each zone, FIG. 1 only shows the lowest floors 9, 10*b* and 11*b* and highest floors 10, 11 and 12. The disadvantages of this system are as stated above.

FIGS. 2–6 present a system according to the invention. In this system, the separate elevator bank 1 for the lowest zone presented in FIG. 1 as well as all the elevator lobbies on these floors have been left out. The system only comprises two banks of elevator shafts. In this example, the first bank 13 comprises eight elevator shafts, each shaft accommodating an elevator provided with a double-decker elevator car 21 and at least as fast as or faster than the elevators operating in bank 14. The ground floor 9 is provided with an escalator arrangement 20 that passengers can use to ascend to and descend from the second ground floor level 9*a*. In the lower part 15 of bank 13, the elevator cars can only be entered from the ground floors 9 and 9*a* and from the elevator lobbies 10 and 10*a* on the first transfer level 8. Likewise, in the upper part 16 of bank 13, there is no entry into the elevator cars except from the elevator lobbies 10 and 10*a* at the first transfer level and from the elevator lobbies 11 and 11*a* at the second transfer level 8*a*. In the case of the present example, the first elevator bank 13 extends from the ground floor to a height corresponding to about ⅔ of the entire height of the building, i.e. in a 45-floor building the second transfer level 8*a* at the top of the first bank comprises floors 30 and 31 of the building and similarly the first transfer level located midway up the first bank comprises floors 15 and 16 of the building.

The second elevator bank 14 extends substantially continuously from the ground floor 9 of the building through the entire height of the building, i.e. to the topmost floor 45, which is represented by elevator lobby 12. The second elevator bank 14 consists of three zones substantially similar to each other and situated one above the other. The shafts in these zones are hereinafter called local shafts 17, 18, 19. All local shafts are substantially identical in cross-section and each local shaft accommodates one elevator car 22 operating in it, serving all floors within the local shaft. Thus, in the system of the example, each elevator shaft in bank 14 contains three elevators one above the other, each one in its own local shaft. In the present context, 'elevator' is to be understood as comprising at least an elevator car 22, a drive machine 23 and hoisting ropes 24. The elevators in the local shafts are slower than or at most as fast as the so-called shuttle elevators in bank 13.

The first and the second elevator banks are interconnected via a two-floor transfer level. The first transfer level 8 is at a height of about one third of the total height of the building, so in the example it comprises floors fifteen and sixteen, provided with elevator lobbies 10 and 10*a*. Similarly, the second transfer level 8*a* is at a height of about two thirds of the total height of the building, comprising in the example floors thirty and thirty-one with elevator lobbies 11 and 11*a*. Each transfer level is provided with an escalator arrangement 20 for transporting passengers from the lower floor of the transfer level to the higher floor or vice versa.

As stated above, the first transfer level 8 and the second transfer level 8*a* each comprise a lower and an upper transfer floor so that each lower transfer floor, which also have elevator lobbies 10 and 11, is the highest floor for the elevator car 22 operating in the local shaft 17 and 18, which comes to that floor from below and leaves it in the downward direction. Similarly, each upper transfer floor, which also have elevator lobbies 10*a* and 11*a*, is the lowest floor for the elevator car 22 operating in the local shaft 18 and 19, which comes to that floor from above and leaves it in the upward direction.

Although the number of parallel shafts chosen for the example is eight, the structure of only one of the shafts in the second bank 14 will now be described. The other shafts are identical to the one described. In its basic structure, each shaft is continuous, extending at least from the ground floor 9 to the top floor of the building if necessary, which has an elevator lobby 12. Each shaft comprises more than one local shaft 17, 18, 19 one above the other, and each local shaft accommodates one elevator with a car 22 serving all floors of the local shaft. The system described in the example thus comprises three local shafts 17, 18 and 19 one above the other, each of which contains one elevator car. All the elevator cars in the same shaft are substantially identical and installed in substantially the same vertical plane one above the other.

Figure 5:
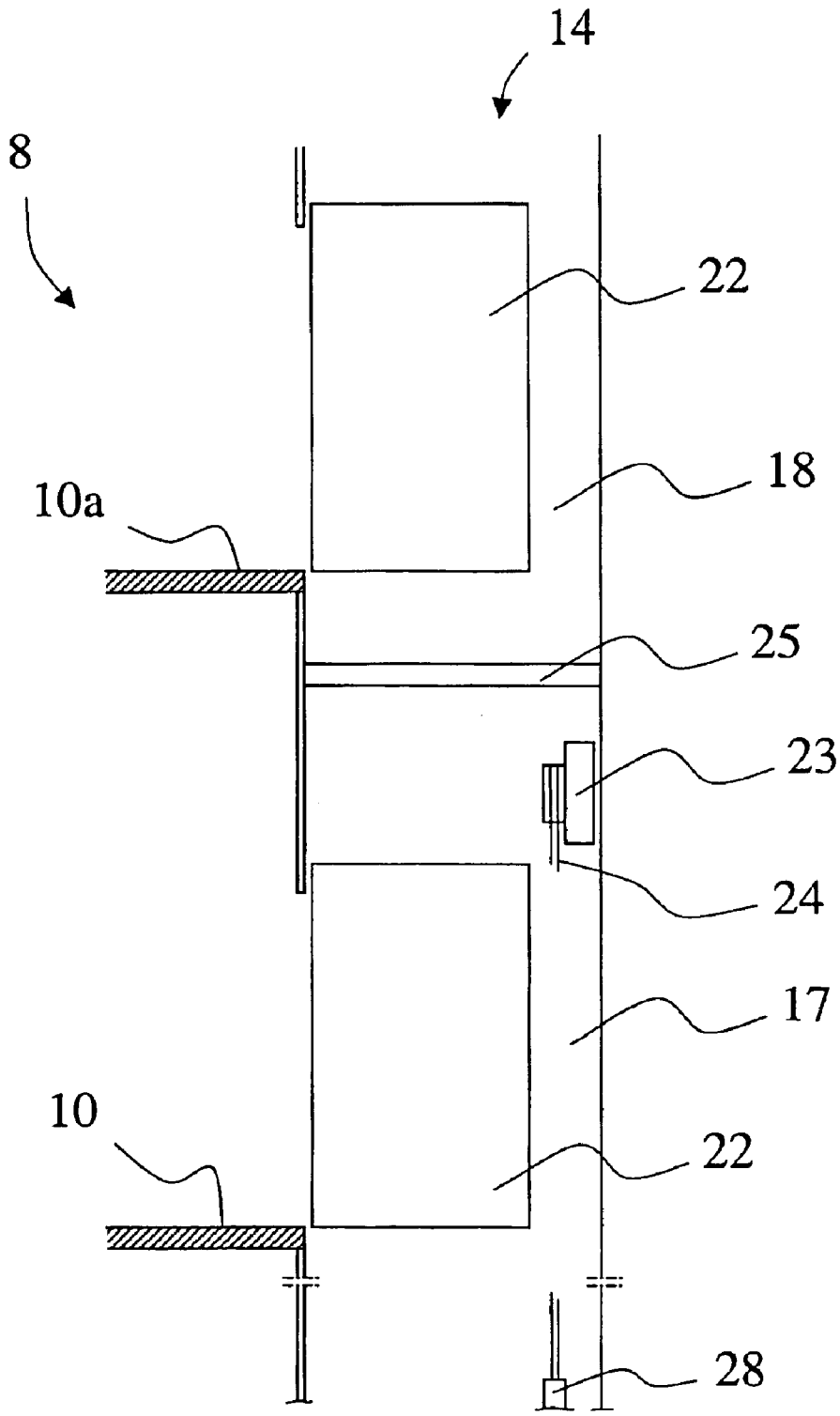
FIG. 5 presents an elevator shaft serving individual floors in an elevator system according to the invention, and the elevator cars in the shaft at a transfer level in lateral view and sectioned along line V—V in FIG. 4.

FIG. 5 presents a more detailed illustration showing how the elevator cars 22 are housed independently of each other one above the other in the same shaft. Here, the elevator car 22 of the middle local shaft 18 is in its lowest position at the upper floor of transfer level 8, at elevator lobby 10*a*. Below the elevator car, the local shaft 18 is provided with a number of supporting beams 25 forming a shaft bottom, which is additionally provided with a strong steel grid to stop any falling objects at this part of the shaft. The vertical direction from the supporting beams to the lowest position of the elevator car 22 has been fitted to be such that a free space of dimensions according to regulations is provided below the car. The local shaft is further provided with fixed buffers mounted on the supporting beams 25 or on a shaft wall in the lower part of the local shaft for stopping the elevator car 22 on buffer. The buffers are not shown in the figures.

Correspondingly, the lower local shaft 17 is provided with an elevator machine 23 for moving the lower elevator car, the machine being mounted below the supporting beams 25 at the upper end of the local shaft, the hoisting ropes 24 being passed around the traction sheave of the machine and fixed in a suitable manner to the elevator car 22. In the figure, the lower elevator car 22 is shown in its highest position in local shaft 17 at transfer level 8, standing at the lower floor of the transfer level, at elevator lobby 10. The elevator machines 23 of all the elevators in the same shaft are mounted in a corresponding manner in the upper part of each local shaft 17 situated one above the other. In the solution illustrated by the example, each shaft also contains three elevator machines 23, and no machine rooms are needed for the elevators in the local shafts 17. Each local shaft is additionally provided with a counterweight 28, which is partially shown in shaft 17. When the elevator car 22 is in the upper part of the shaft, the counterweight is in its lower part and vice versa.

The elevator machine 23 is of gearless type and substantially flat, so it can be mounted e.g. on an elevator guide rail or on a shaft wall in the space between the wall of the elevator car 22 and the shaft wall. Thus, the elevator cars 22 can be easily implemented as units independent of each other because the hoisting ropes of different elevators are not interlapped in the vertical direction in any part of the shaft.

Figure 6:
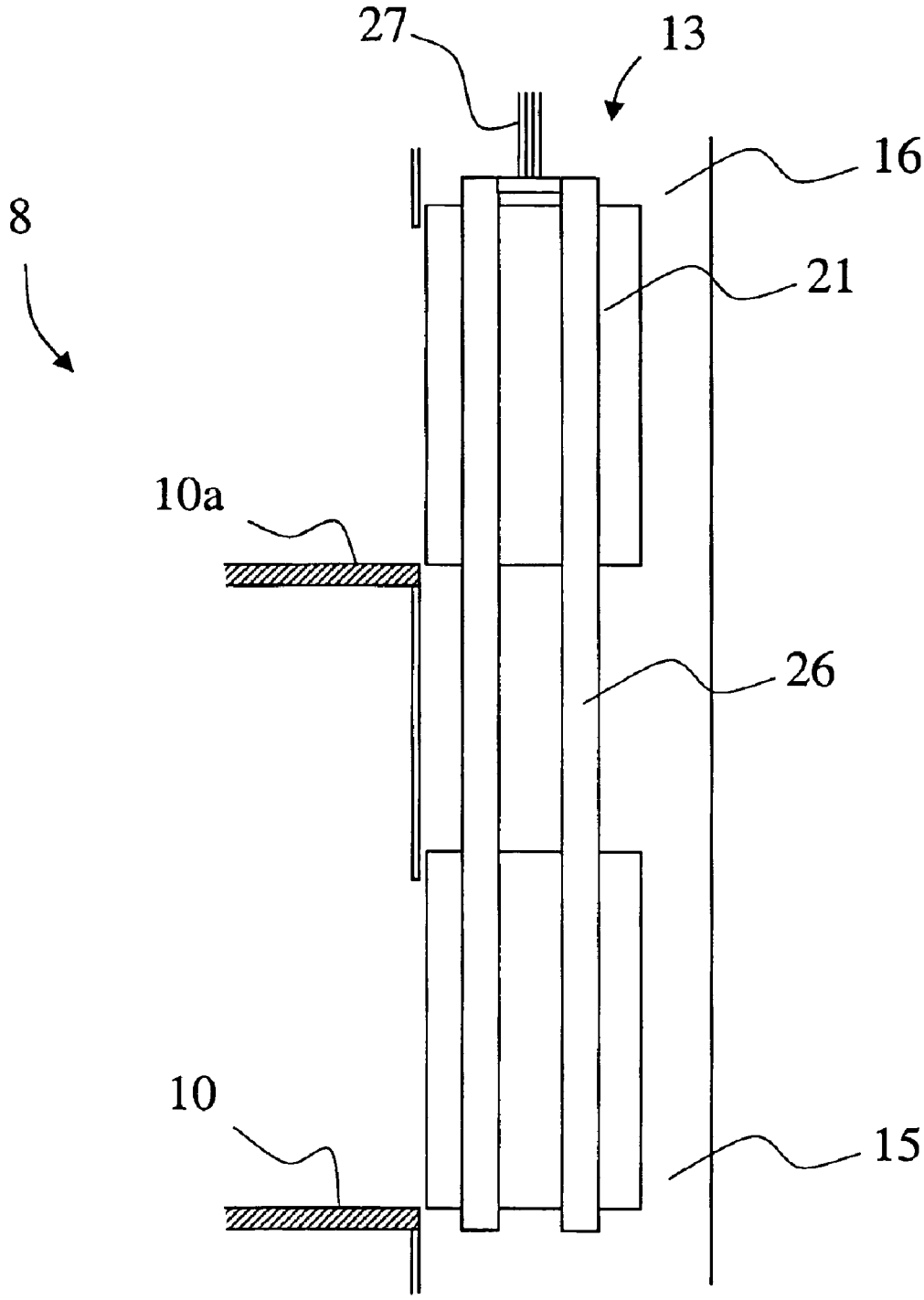
FIG. 6 presents an elevator shaft serving the transfer levels in an elevator system according to the invention and a double-decker elevator car in the shaft at a transfer level, in lateral view and sectioned along line VI—VI in FIG. 4.

FIG. 6 presents a likewise simplified view of a double-decker elevator car 21 operating in the elevator shafts of the first bank 13. In this case, an elevator machine is provided at the upper end of each shaft, with an elevator car 12 suspended on its ropes. The upper and lower cars of the elevator car are connected to each other via fixing elements 26 so that, when the upper car is at the upper floor of the first transfer level 8, the lower car is at the lower floor of the same transfer level. The same also applies when the car is at the second transfer level 8*a* or at the ground floor 9.

The ground floor and transfer level lobbies are provided with clear guide signs to inform passengers as to the level from which each floor can be reached. Now, supposing a passenger wants to go to floor twenty, he will see at the ground floor a guide sign indicating that the floor in question can be reached by taking any elevator starting from the ground floor 9. The passenger then boards the lower car of a double-decker elevator car 21 in bank 13 from the ground floor 9 and ascends to the second transfer level 8*a*, where he exits from the elevator at lobby 11 and walks along the transfer floor to an elevator car 22 in bank 14, which takes him downward from floor thirty to floor twenty. If the passenger is going to floor fifty, he will first go by escalator to the upper level 9*a* and then board the upper car of a double-decker elevator car 21 to reach transfer level 8*a*, where he goes further via elevator lobby 11*a* to an up-going elevator in bank 14, which takes him to the desired floor.

It is obvious to the skilled person that the invention is not limited to the example presented above, but that it may be varied within the scope of the claims presented below. Thus, for example, the elevator machines may be only partially located in the elevator shafts, e.g. so that substantially only the traction sheave is in the elevator shaft while the rest of the elevator machine is in a suitable recess or equivalent set back from the shaft. An essential point is that each elevator car in the shaft has its own machine near the upper or lower end of the shaft section in which the car travels. Further, the number of vertical zones is not necessarily three but may vary according to building height, required transport capacity and selected elevator properties. These properties include e.g. the speed and size of the elevator car. The heights of the shafts needed are preferably so chosen that a double-decker elevator car 21 arriving at the highest transfer level can disembark passengers for both upward and downward transfer traffic.

Thus, the relation of the number of transfer levels and local shafts may vary in buildings of different heights. In addition, buildings of a height greater than in the example described above may have more transfer levels than two as in the example. Likewise, the height of the shafts may vary according to the shape of and space available in the building.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An elevator system in tall buildings, said system comprising at least one first elevator shaft, which houses an elevator arranged to stop at floors called transfer levels, and at least one second elevator shaft, which houses elevators whose elevator cars are disposed one above the other in the elevator shaft, which elevator cars are designed to stop during their travel at any floor to which or from which a call has been issued and that the second elevator shaft is divided vertically into local shafts situated one above the other, the number of which is at least one for each zone between transfer levels, and that the elevators in the local shafts are arranged to travel one above the other in the same shaft in such manner that they have their paths in shaft spaces disposed one above the other, characterized in that each elevator travels between the highest and lowest floors of its own local shaft, and that, except for the topmost elevator, the highest floor for each elevator is the next floor below the lowest floor for the elevator immediately above it and that each transfer level comprises an upper and a lower transfer floor so that each lower transfer floor is the highest floor for the elevator car operating in the local shaft that arrives at it and departs from it in downward direction, and that each upper transfer floor is the lowest floor for the elevator car operating in the local shaft that arrives at it and departs in the upward direction.

2. The elevator system according to claim 1, characterized in that each local shaft contains at least an elevator car traveling in the shaft and the required elevator ropes.

3. The elevator system according to claim 1, characterized in that, in addition to the elevator car and hoisting ropes, each local shaft contains an elevator machine driving the elevator and a counterweight.

4. The elevator system according to claim 2, characterized in that the elevator car, elevator ropes and counterweigh in each local shaft are fitted to operate within the area of their own local shaft only.

5. The elevator system according to claim 1, characterized in that the elevator machine of the elevator operating in each local shaft is mounted in the upper part of the shaft space near the upper end of the local shaft.

6. The elevator system according to claim 1, characterized in that the elevator machine in the local shaft is mounted in the space between the elevator car traveling in the shaft and a shaft wall.

7. The elevator system according to claim 1, characterized in that each transfer level comprises an upper and a lower transfer floor so that each lower transfer floor is the highest floor for the elevator car operating in the local shaft that arrives at it and departs from it in downward direction, and that each upper transfer floor is the lowest floor for the elevator car operating in the local shaft that arrives at it and departs in the upward direction.

8. The elevator system according to claim 1, characterized in that the elevator shaft is provided with a supporting structure between the local shafts and so implemented that it forms a shaft bottom for the elevator immediately above it and separates from each other the local shafts situated one above the other.

9. The elevator system according to claim 8, characterized in that the supporting structure is so positioned between the local shafts situated one above the other that, when the elevator car is at its highest position, a free space of sufficient height between the supporting structure and the elevator car remains in the upper part of the lower shaft, and that when the elevator car is at its lowest position, a free space of sufficient height between the supporting structure and the elevator car remains in the lower part of the upper shaft.

* * * * *